US005664512A

United States Patent [19]

Foster et al.

[11] Patent Number: 5,664,512

[45] Date of Patent: Sep. 9, 1997

[54] GARMENT PIECE POSITIONER AND SEAMER

[75] Inventors: Wayne G. Foster; John R. Everhart, both of Winston-Salem; Ken J. Thompson, Lexington, all of N.C.

[73] Assignee: Sara Lee Corporation, Winston-Salem, N.C.

[21] Appl. No.: 505,553

[22] Filed: Jul. 21, 1995

[51] Int. Cl.[6] ..... D05B 21/00

[52] U.S. Cl. ..... 112/470.07; 112/475.03; 112/475.07; 271/278

[58] Field of Search ..... 112/470.06, 470.07, 112/470.03, 470.36, 475.07, 475.02, 475.03, 475.19, 102.5, 272, 278; 901/46, 47, 49; 271/227, 241, 253

[56] References Cited

U.S. PATENT DOCUMENTS 4,425,858 1/1984 Hargett ..... 112/470.07 X
4,917,030 4/1990 Bisson et al. ..... 112/470.07
5,131,339 7/1992 Goodridge ..... 112/470.07 X
5,537,946 7/1996 Sadeh et al. ..... 112/470.07 X

*Primary Examiner*—Peter Nerbun
*Attorney, Agent, or Firm*—Rhodes Coats & Bennett, L.L.P.

[57] ABSTRACT

An apparatus for receiving a garment piece at a first workstation and moving the garment piece to a second workstation where the garment piece is seamed together. The apparatus includes a garment piece transfer system located adjacent to the first workstation for engaging the garment piece at the first workstation and for moving the garment piece to the second workstation. A vision and control system is located adjacent to the first workstation for determining the position of the garment piece at the first workstation and sending a control signal to the garment piece transfer system to engage the garment piece at the first workstation and move the garment piece to the second workstation. A sewing machine is located at the second workstation for seaming the garment piece together. The vision and control system also determines a parameter value for a selected parameter of the garment and places the garment into a reject or a non-reject class based on a comparison of the parameter value and a reference value. The garment piece is moved to the second workstation for sewing in response to the garment being placed in the non-reject class.

39 Claims, 10 Drawing Sheets

GARMENT PIECE POSITIONER AND SEAMER

BACKGROUND OF THE INVENTION (1) Field of the Invention

The present invention relates generally to automated manufacturing systems and, more particularly, to an apparatus for automatically seaming a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, sleeves and pant legs must be sewn "inside out" in order to make a garment having clean seams. This has always been a manual operation because of the dexterity required to locate the cut fabric piece, inspect it for defects and feed it into the sewing machine. Unfortunately, repetitive actions such as sewing a garment may cause health problems. However, it has been extremely difficult to design a device which can reliably locate, inspect and sew a fabric piece to form a garment piece such as a sleeve or pant leg time after time.

Thus, there remains a need for an apparatus for automatically seaming a sleeve or pant leg for a sweat suit or the like which will operate reliably time after time while, at the same time, it can be carried out completely automatically without the need for a skilled operator.

SUMMARY OF THE INVENTION

The present invention is directed to an apparatus for receiving a garment piece at a first workstation and moving the garment piece to a second workstation where the garment piece is seamed together. The apparatus includes a garment piece transfer system located adjacent to the first workstation for engaging the garment piece at the first workstation and for moving the garment piece to the second workstation.

In the preferred embodiment, the transfer system includes a support table located between the first workstation and the second workstation. The support table has a smooth, generally horizontal planar top surface for supporting the garment piece thereon. A robot is positioned adjacent to the table and has an arm and presser foot attached thereto. The robot arm includes means for selectively moving the presser foot between a non-engagement position and an engagement position with the planar surface whereby the presser foot engages the garment piece on the surface of the support table. The robot also includes means for rotating the presser foot to orient it with respect to the garment piece. Finally, the robot arm includes means for moving the presser foot between the first workstation and the second workstation when in the engagement position to slidably move the garment piece along the surface of the table from the first workstation to the second workstation.

A vision and control system is located adjacent to the first workstation for determining the position of the garment piece at the first workstation and sending a control signal to the garment piece transfer system to engage the garment piece at the first workstation and move the garment piece to the second workstation.

A sewing machine is located at the second workstation for seaming the garment piece together.

Accordingly, one aspect of the present invention is to provide an apparatus for receiving a garment piece at a first workstation and moving the garment piece to a second workstation. The apparatus includes: (a) a garment piece transfer system located adjacent to the first workstation for engaging the garment piece at the first workstation and for moving the garment piece to the second workstation; and (b) a vision and control system located adjacent to the first workstation for determining the position of the garment piece at the first workstation and sending a control signal to the garment piece transfer system to engage the garment piece at the first workstation and move the garment piece to the second workstation.

Another aspect of the present invention is to provide a garment piece transfer system for moving a garment piece from a first workstation to a second workstation. The apparatus includes: (a) a support table located between the first workstation and the second workstation having a smooth, generally horizontal planar top surface for supporting the garment piece thereon; and (b) a robot positioned adjacent the table and having an arm and presser foot attached thereto, the robot arm including means for selectively moving the presser foot between a non-engagement position and an engagement position with the planar surface whereby the presser foot engages the garment piece on the surface of the support table, the robot arm including means for moving the presser foot between the first workstation and the second workstation when in the engagement position to slidably move the garment piece along the surface of the table from the first workstation to the second workstation.

Still another aspect of the present invention is to provide an apparatus for receiving a garment piece at a first workstation and moving the garment piece to a second workstation. The apparatus includes: (a) a garment piece transfer system located adjacent to the first workstation for engaging the garment piece at the first workstation and for moving the garment piece to the second workstation, the transfer system includes: (i) a support table located between the first workstation and the second workstation having a smooth, generally horizontal planar top surface for supporting the garment piece thereon; and (ii) a robot positioned adjacent the table and having an arm and presser foot attached thereto, the robot arm including means for selectively moving the presser foot between a non-engagement position and an engagement position with the planar surface whereby the presser foot engages the garment piece on the surface of the support table, the robot arm including means for moving the presser foot between the first workstation and the second workstation when in the engagement position to slidably move the garment piece along the surface of the table from the first workstation to the second workstation; (b) a vision and control system located adjacent to the first workstation for determining the position of the garment piece at the first workstation and sending a control signal to the garment piece transfer system to engage the garment piece at the first workstation and move the garment piece to the second workstation; and (c) a sewing machine located at the second workstation for performing a sewing operation on the garment piece.

These and other aspects of the present invention will become apparent to those skilled in the art after a reading of the following description of the preferred embodiment when considered with the drawings.

DESCRIPTION OF THE PREFERRED EMBODIMENTS

Figure 1:
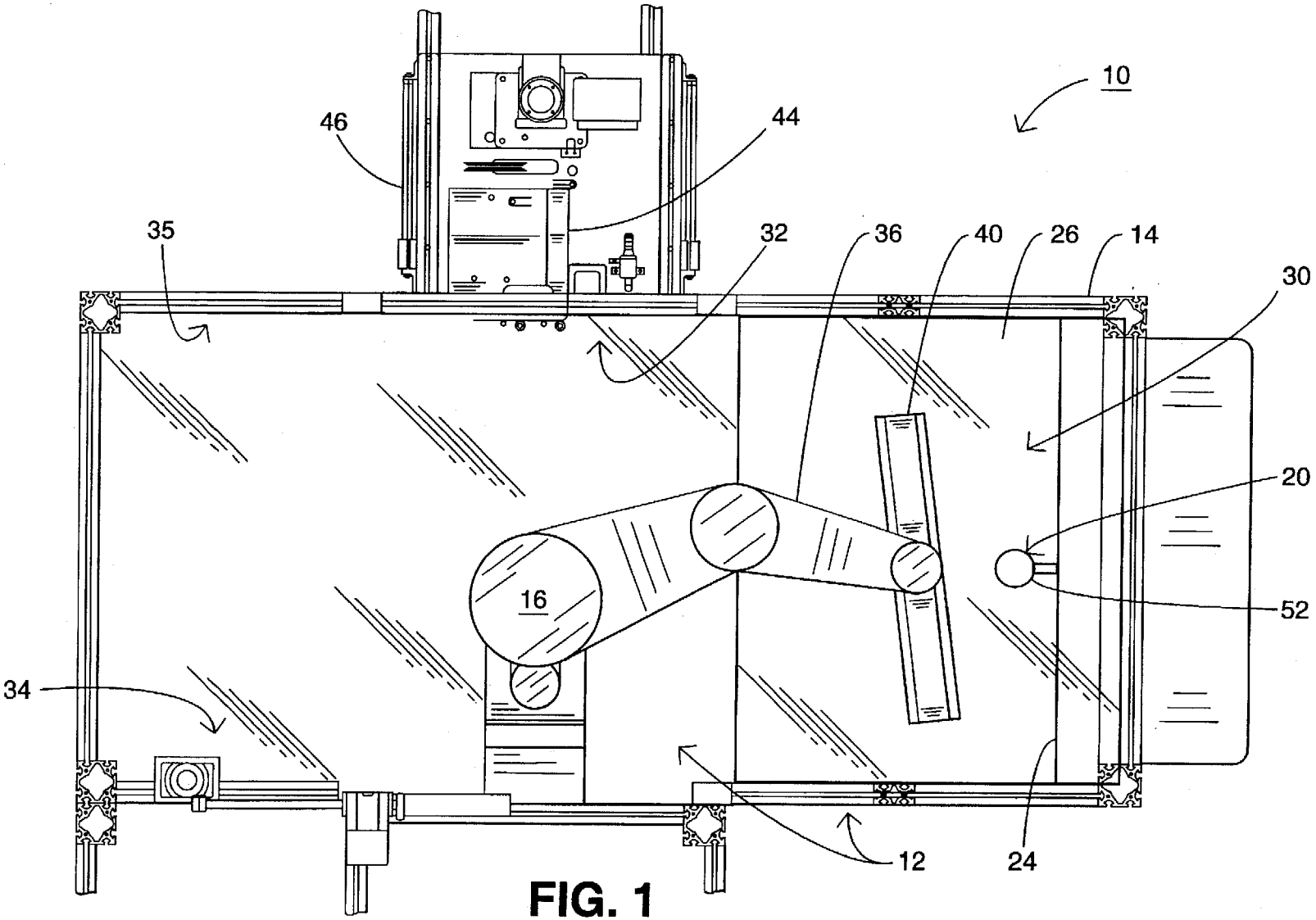
FIG. 1 is a plan view of a garment piece positioner and seamer constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a garment piece positioner and seamer, generally designated 10, is shown constructed according to the present invention.

Garment piece positioner and seamer 10 is used in the apparel industry to assemble clothing articles. In the assembling process of a clothing article, a garment piece must be moved to one or more assembling stations. The garment piece is sewn, attached to other garment pieces, and/or transferred to other apparatuses at the various assembling stations to create a clothing article.

Garment piece positioner and seamer 10 can be used to assemble a wide variety of clothing articles. The preferred embodiment of garment piece positioner and seamer 10 is used to assemble a garment piece into a sleeve for attachment to a shirt. In the preferred embodiment, garment pieces are successively loaded at a loading station 30 where they are moved first to a sewing station 32 for seaming and then to a transfer station 34 for subsequently assembling the garment piece into a finished sleeve.

Garment piece positioner and seamer 10 includes a positioner 12 for moving garment pieces to assembling stations 32,34 and a vision system 20 for controlling positioner 12. Positioner 12 includes a table 14 and robot 16. Robot 16 slidably moves a garment piece over table 14 to position the garment piece from loading station 30 to stations 32, 34. Robot 16 moves a garment piece between stations 30–34 by slidably moving the garment piece over table 14. The movement of robot 16 is controlled by vision system 20 which includes a camera 52 and a controller (not shown). Vision system 20 locates a garment piece that has been randomly loaded onto table 14 at the loading station 30 and produces garment piece location data which corresponds to the garment piece's location. The garment piece location data is communicated to robot 16 which uses the data to selectively engage the garment piece and to control the movement of robot 16 in order to precisely position the garment piece at stations 32, 34.

Figure 2:
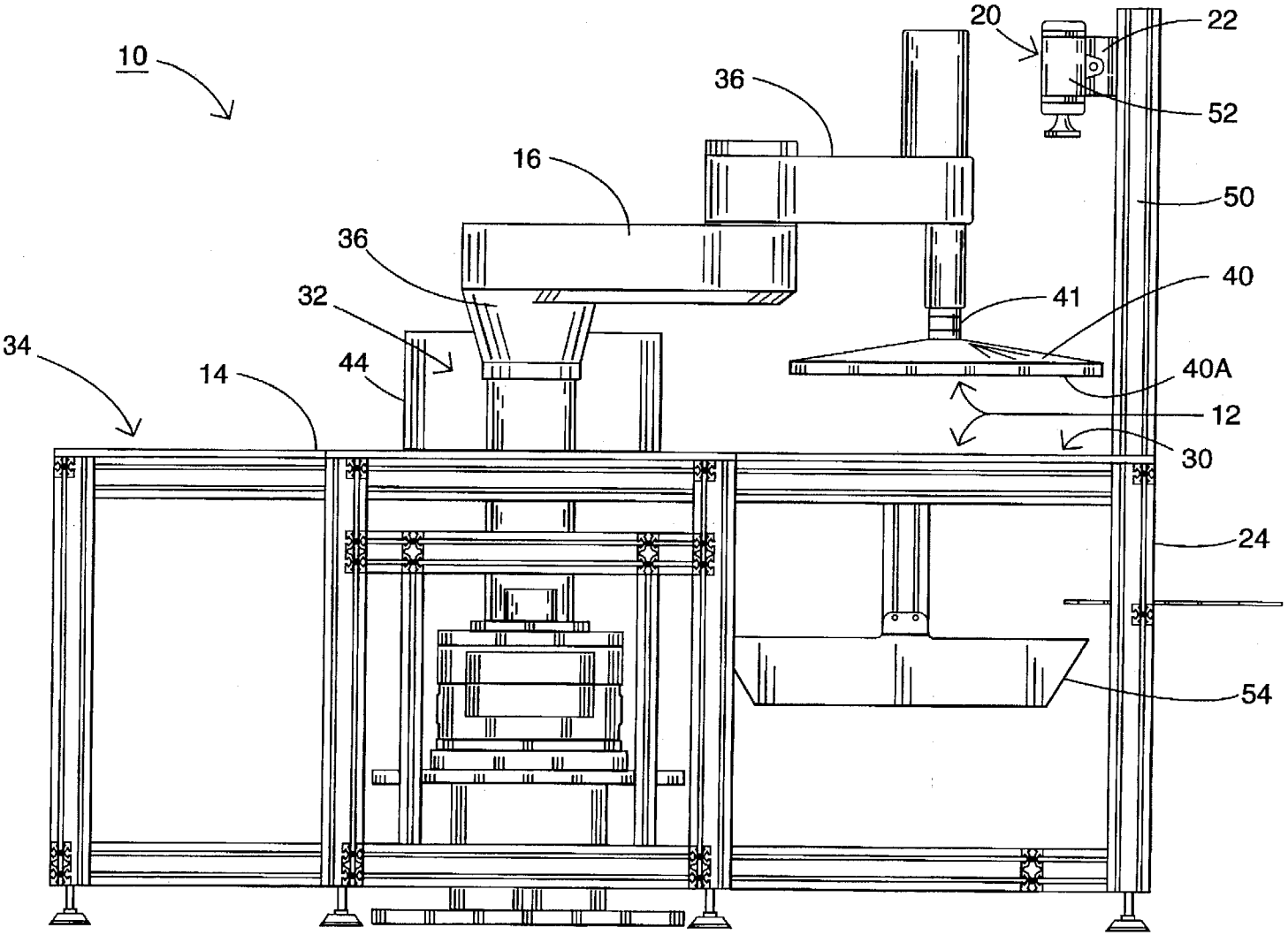
FIG. 2 is a side elevation view of the garment piece positioner and seamer shown in FIG. 1.

As shown in FIGS. 1 and 2, robot 16 is adjacently positioned to table 14. Table 14 includes a support frame 24 and a generally horizontal planar surface 26. The planar surface 26 of table 14 is designed to have a smooth surface so that a garment piece can be slidably moved over the planar surface 26 with minimum frictional resistance. In the preferred embodiment, the generally horizontal planar surface 26 is made from glass or transparent plastic.

Located around table 14 are loading station 30, sewing station 32, and transfer station 34. Loading station 30 provides an area where a garment piece can be initially positioned on the table 14. Sewing station 32 includes a sewing machine 44 that functions to sew along a selected line of a garment piece moved through the stationary sewing station 32. Sewing machine 44 is supported by a sewing machine table 46 that can be automatically retracted from table 14 for necessary repairs. Transfer station 34 is the last work station for the garment piece positioner and seamer 10 and the garment piece is transferred from station 34 for further assembling.

Robot 16 includes a robot arm 36 and an attached robot presser foot 40 positioned above table 14 for precisely positioning a garment piece from loading station 30 to stations 32 and 34. Presser foot 40 is attached to a tool changer 41 located at one end of robot arm 36. Tool changer 41 and attached robot presser foot 40 can be positioned in both vertical and horizontal directions with respect to table 14. In addition, robot presser foot 40 can be rotated in a plane parallel to the planar surface 26 of table 14. Rotating presser foot 40 varies the orientation at which the robot presser foot 40 is attached to robot arm 36. The ability to move robot presser foot 40 in this manner allows presser foot 40 to selectively engage a garment piece loaded at loading station 30 and to then slidably move the engaged garment piece to stations 32 and 34. Presser foot 40 has a planar bottom surface 40A for engaging a garment piece that has been laid flat on table 14 at loading station 30.

Presser foot 40 is placed in an engagement position with a garment piece on table 14 by positioning bottom surface 40A against the garment piece such that the garment piece is sandwiched between presser foot 40 and table 14. Placing the presser foot 40 in the engagement position results in the garment piece being frictionally engaged by presser foot 40. Presser foot 40 is positioned on a selected portion of the garment piece when in the engagement position. With the presser foot 40 in the engagement position, the garment piece can be slidably moved along table 14 by moving presser foot 40 in a planar path. Presser foot 40 is sized so that bottom surface 40A has a surface area capable of engaging a sufficient amount of the garment piece's surface area so that the garment piece is maintained in a flat position as the garment piece is moved.

In the preferred embodiment, a felt-type material is attached to the bottom planar surface of presser foot 40. The felt-type material has a higher coefficient of friction than that of the planar surface 26 of table 14. This allows the presser foot 40 to maintain contact with the garment piece as it is moved across the surface of the table to the next workstation.

Robot 16 includes a robot processor (not shown) for directing the movement of robot arm 36 and attached robot presser foot 40. The robot processor uses location data to position presser foot 40 in the engagement position and to selectively position the garment piece at stations 32 and 34. The location data used to position presser foot 40 includes data which represents the fixed locations of sewing machine 44, transfer station 34, and the position of robot presser foot 40 when it is in an operator-defined home position. In addition, the location data includes data generated by the vision and control system 20 that represents the location in the loading station 30 of a randomly loaded garment piece. By processing the fixed location data, the robot processor can selectively engage a loaded garment piece and control the path of travel of robot arm 36 and the orientation of robot presser foot 40.

In order for robot 16 to engage a garment piece which has been randomly loaded onto table 14 at loading station 30, the position of the garment piece on table 14 must be inputed to the robot processor. Vision system 20 is provided to locate a garment piece loaded at the loading station 30 and to produce garment piece location data which represents the position of the garment piece on table 14. The garment piece location data is communicated from vision system 20 to robot 16 for use in controlling the positioning of a garment piece by robot 16.

Vision system 20 includes camera 52 which is supported above the loading station 30 by camera support 50. Camera 52 is used to take pictures of the loading station 30 to locate the position of a garment piece located in the loading station 30. To enable vision system 20 to locate a garment piece, a vision back-lighting apparatus 54 is positioned beneath table 14 at loading station 30. Vision back-lighting apparatus 54 shines light upwardly through the transparent, planar surface 26 of table 14. A garment piece placed at the loading station 30 blocks light produced by vision back-lighting 54. Vision system 20 locates the garment piece by detecting where light is being blocked on the table 14.

Figure 3:
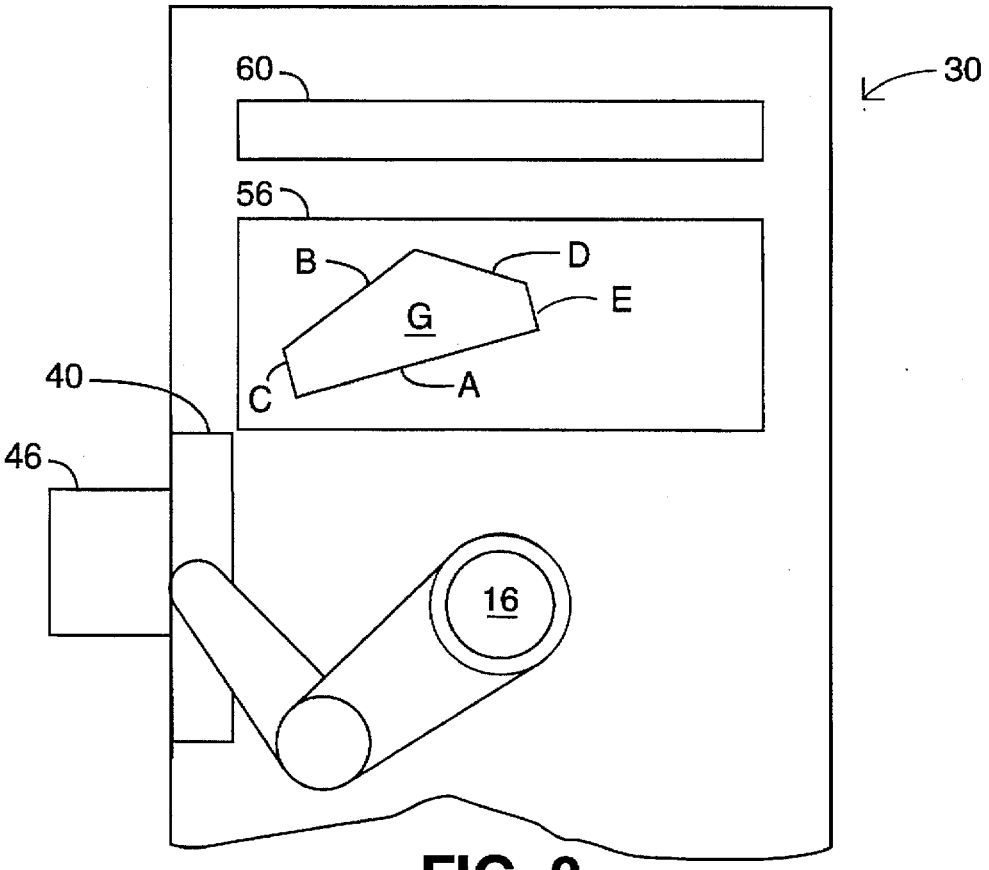
FIG. 3 is a partial, enlarged plan view of FIG. 1 illustrating a garment piece loaded on the table at the loading station.

As shown in FIG. 3, vision system 20 divides loading station 30 into an inspection area 56 and a protection area 60. Protection area 60 is located at a forward section of loading station 30 and inspection area 56 is located in an adjacent, rear section of loading station 30. As will be described in more detail below, the protection area 60 is a safety feature designed to prevent the operation of robot 16 when an operator's hands have not been moved free of the table 14, and inspection area 56 is the area where the loaded garment piece is inspected and first engaged by robot 16.

In the preferred embodiment, garment piece positioner and seamer 10 is used to assemble a garment piece into a sleeve. The garment piece loaded onto table 14 at loading station 30 is a single sheet of fabric that has been folded over. As shown in FIG. 3, a garment piece G has been loaded into the inspection area 56 and includes a fold edge A, a sewing edge B, a cuff edge C, and a shoulder opening D. Garment piece G is folded over at fold edge A so that the garment piece has a bottom fabric layer and an overlapping, top fabric layer. The bottom and top layers of the garment piece are not connected to one another at sewing edge B, cuff edge C, and shoulder opening D. Garment piece positioner and seamer 10 functions to sew closed the bottom and top layers of a garment piece along and adjacent sewing edge B and to selectively position cuff edge C at transfer station 34.

Figure 4:
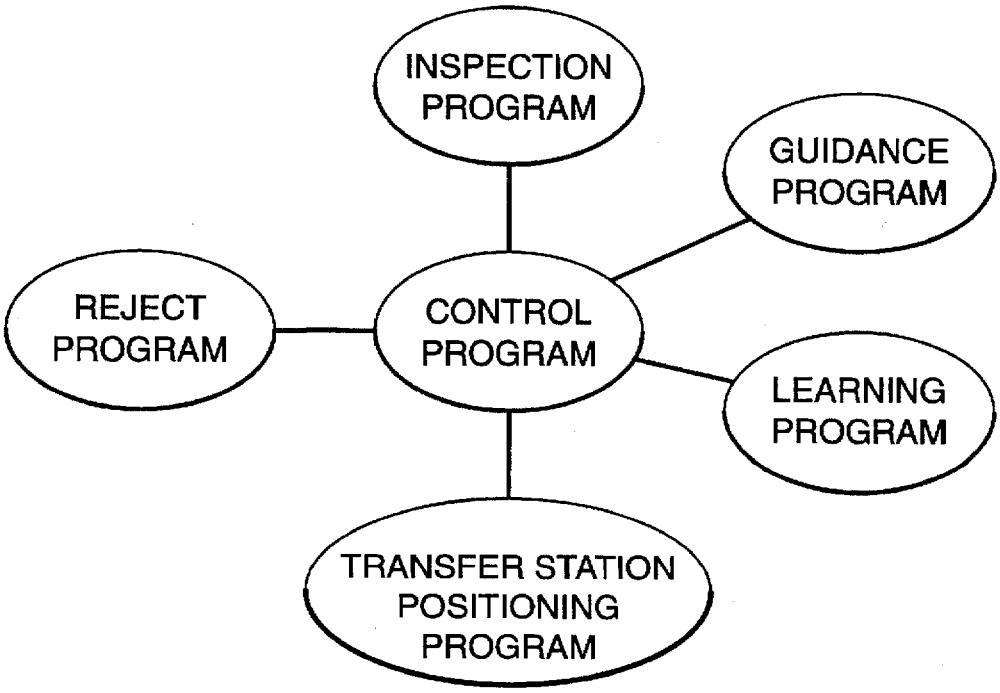
FIG. 4 is a schematic of the operations program used to control the positioner and seamer.

An operations program controls the operation of garment piece positioner and seamer 10 such that successively loaded garment pieces are assembled into sleeves. As shown by FIG. 4, the operations program includes an inspection program, a guidance program, a learning program, a transfer station positioning program, and a reject program. As depicted in FIG. 4, the operations program includes a control program for controlling the overall operation of garment piece positioner and seamer 10.

Each of these programs performs a different function in controlling the garment piece positioner and seamer 10. The inspection program tests a garment piece loaded on the loading station 30 and determines whether the loaded garment piece should be rejected as unsuitable. The guidance program and pattern learning program provide for two different methods to selectively position a loaded garment piece at the sewing station 32 to sew the sewing edge B of the garment piece. The transfer station positioning program detects the location of the cuff edge C of a garment piece and selectively positions the cuff edge C at the transfer station 34. The reject program disposes of a loaded garment piece that has been determined by the vision system 20 to be defective.

Figure 5:
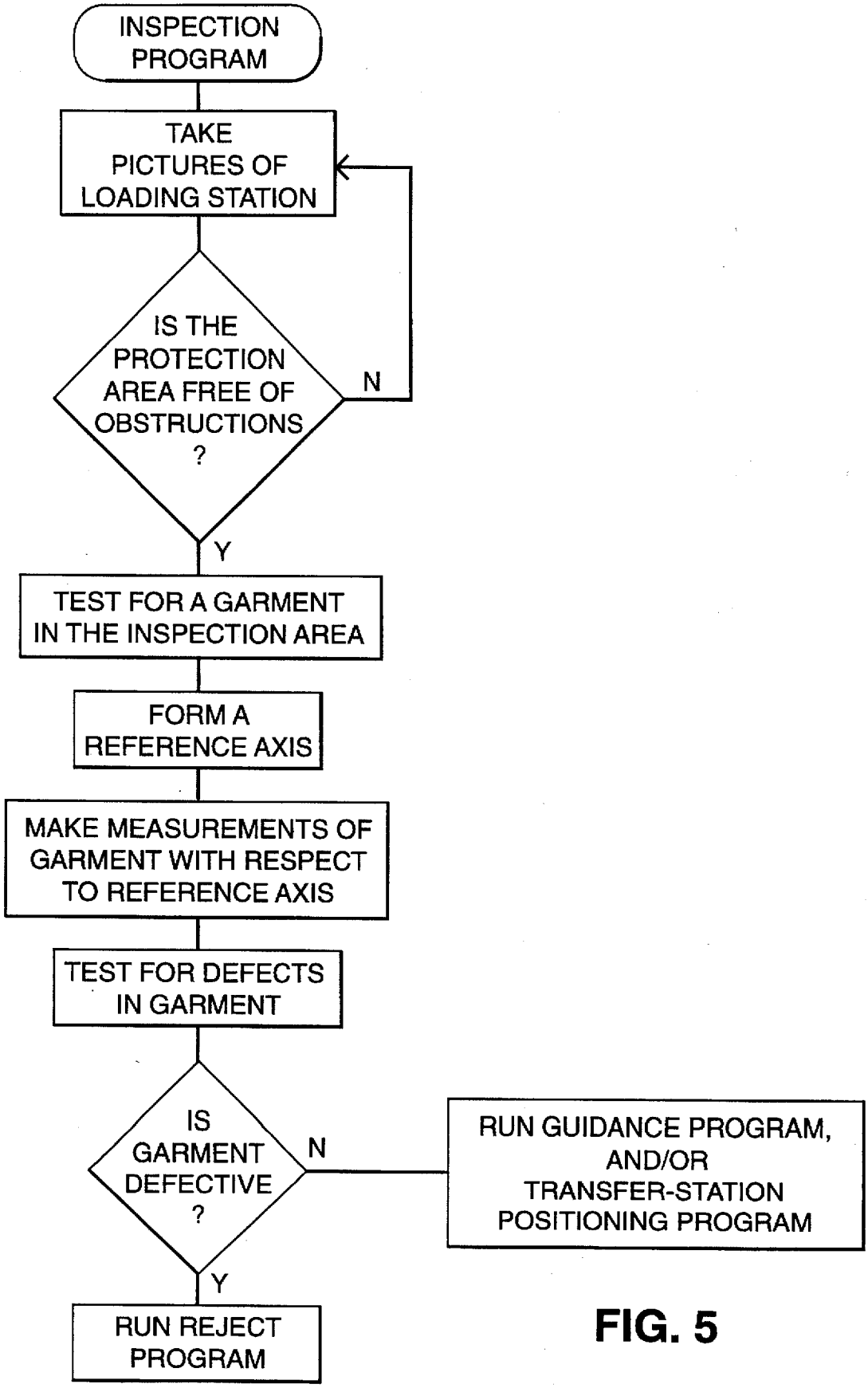
FIG. 5 is a flow chart of the inspection program.

With reference to the flow chart shown in FIG. 5, the inspection program operates as follows. Camera 52 is turned on to repeatedly take pictures of loading station 30. Vision system 20 first analyzes the pictures to determine if the designated protection area 60 is free of obstructions. A person's arm or a portion of the garment piece in the protection area 60 will result in vision system 10 detecting an obstruction. If an obstruction is detected, vision system 20 will not signal robot 16 to move from its home position to the loading station 30. Accordingly, robot 16 is prevented from moving to the loading station at any time during operation of the garment piece positioner and seamer 10 unless the loading station is free of obstructions. Continuously checking for an obstruction in protection area 60 is a safety feature that helps prevent a person loading garment pieces from being struck and injured by robot 16. In addition, the inspection program will not proceed until the garment piece being loaded is fully inserted into the inspection area 56 and no section of the garment piece is overlying protection area 60. The person loading the garment pieces is notified that the garment piece has not been properly loaded in the inspection area 56.

If the protection area 60 is free of obstructions, the inspection program proceeds and vision system 20 analyzes the pictures of the inspection area 56 to test if a garment piece of sufficient area has been loaded. The area of the loaded garment piece is calculated by determining what portion of the inspection area 56 is blocked by the loaded garment piece. The measure area of the garment piece is then compared to stored reference data to determine if a garment of sufficient area has been loaded.

Figure 6:
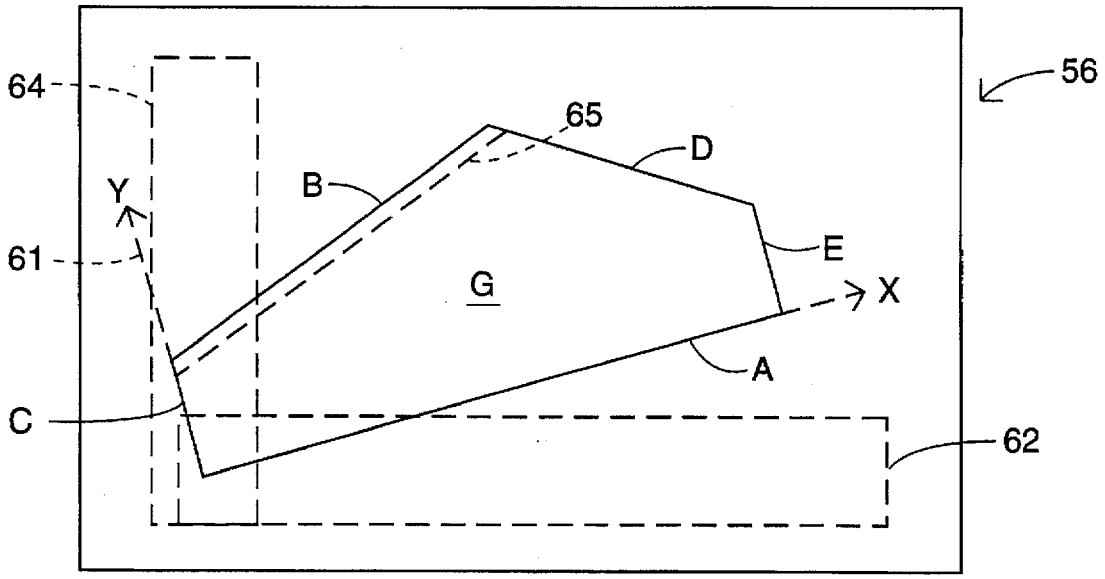
FIG. 6 is a top view showing a garment piece loaded at the loading station and a schematic depiction of the garment piece being located by the vision system.

The inspection program also analyzes the pictures and locates in inspection area 56 a reference axis 61 having an x-axis and a y-axis, as shown in FIG. 6. The reference axis 61 is formed on the loaded garment piece with the origin of the reference axis 61 located at the corner of the fold edge A and cuff edge C of the garment piece. The x-axis of the reference axis 61 fits approximately along fold edge A and the y-axis extends from the origin in perpendicular relation with the x-axis.

It is necessary to form a reference axis 61 on the loaded garment piece so that measurements can be made of the garment piece and the position of the garment piece can by determined. The garment piece loaded into inspection area 56 is loaded randomly and has no fixed or exact position in inspection area 56. The position of the garment piece is determined by locating the reference axis 61 on the garment piece.

Several steps are performed by vision system 20 to form the reference axis on the garment piece. As shown in FIG.

6, the inspection area 56 is segmented to include a first search region 62 and a second search region 64. The first search region 62 is located along a rearward section of the inspection area 56 and the second search region 64 is located along one side of the inspection area 56, as shown in FIG. 6.

The vision system 20 analyzes the first search region 62 to locate fold edge A of the garment piece and forms the x-axis of the reference axis along fold edge A. The vision system 20 also analyzes the second search region 64 to locate cuff edge C. Accordingly, at least a section of the fold edge A of the garment piece must be located in the first search region 62 for the reference axis to be formed on the garment piece. The locations of cuff edge C and fold edge A are processed by the vision system 20 to determine the location of the intersection of fold edge A and cuff edge C. The origin of the reference axis is located at this intersection. The x-axis is extended from the origin to approximately along fold edge A and the y-axis is extended perpendicular from the x-axis.

Once the reference axis has been formed on the garment piece in this manner, the inspection program makes measurements of the garment piece. In particular, the distance between the fold edge A and sewing edge B at various points along the x-axis is calculated. These distance measurements are then compared with reference distances that correspond to an ideal or suitable garment piece to determine if the loaded garment piece is defective. Other tests such as whether there are holes in the garment piece are also made. If the garment piece is determined to be defective then the reject program can be run to discard the garment piece.

Figure 7:
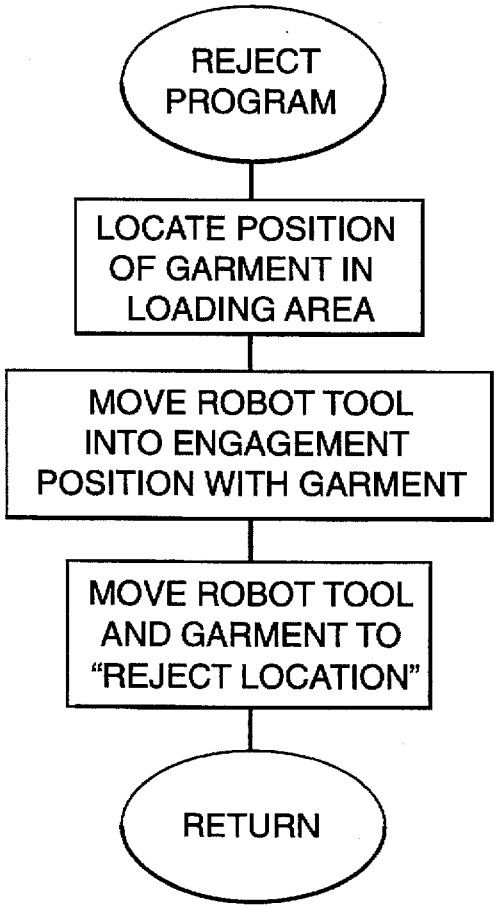
FIG. 7 is a flow chart of the reject program.

Referring to FIG. 7, the reject program operates to discard a garment piece determined to be a reject. The reject program operates by first locating the position of the garment piece to be rejected. Robot 16 is then moved to loading station 30 and into engagement with the garment piece. Robot 16 is then moved in a planar path to a reject location 35 where the garment piece is moved off of the surface of the table into a reject bin (not shown).

Figure 8:
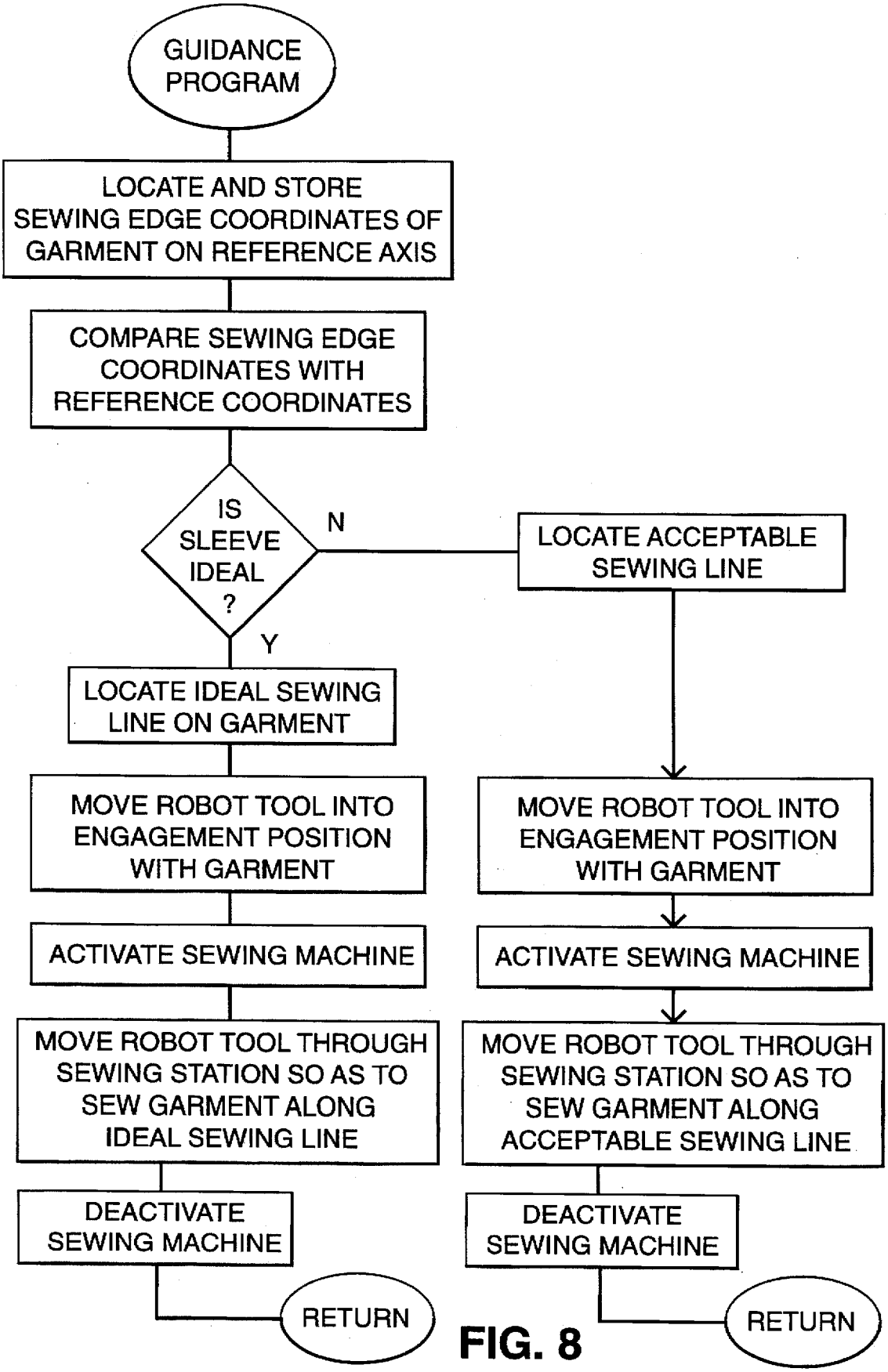
FIG. 8 is a flow chart of the guidance program.

If the garment piece is determined not to be a reject, the guidance program and/or the transfer station positioning program are run. Referring to FIG. 8, the guidance program is run when garment pieces having a sewing edge B with a known pattern are being loaded and reference coordinates corresponding to sewing edge B have been previously inputed. The guidance program determines where the sewing line 65, shown in FIG. 6, will be located on the garment piece and operates as follows. First, the coordinates of the sewing edge B on the reference axis are located and stored. The sewing edge coordinates are then compared with ideal sewing edge coordinates to determine if the garment piece falls within an ideal garment piece class.

If the garment piece falls within an ideal garment piece class, then an ideal sewing line is located on the garment piece. The ideal sewing line is spaced a selected distance from fold line A and extends generally adjacent to sewing edge B. Vision system 20 then directs robot presser foot 40 to move to loading station 30 and engage the garment piece at a selected distance from the ideal sewing line.

In order to engage the garment piece at a select distance from the ideal sewing line, robot arm 36 is rotated from its home position to the loading station 30 and the presser foot 40 is positioned over the garment piece. Once presser foot 40 is positioned over the garment piece, the presser foot 40 is rotated to align itself with the garment piece. The presser foot 40 is then lowered to engage the garment piece on the surface of the support table.

Robot presser foot 40 is then moved to the sewing station 32 such that the garment piece is slidably moved through sewing machine 44. The sewing machine is activated and the garment piece is selectively moved through sewing machine 44 such that the garment piece is sewn along the ideal sewing line. Any excess material extending outwardly from the ideal sewing line is cut and discarded by sewing machine 44 during the sewing process. The sewing machine 44 is deactivated after the garment piece passes therethrough and the guidance program is ended.

If the guidance program determines that a loaded garment piece is not ideal, then the garment piece is placed in an acceptable garment piece class and an acceptable sewing line is formed on the garment piece. The acceptable sewing line is formed a selected distance from the sewing edge B. Vision system 20 then directs robot presser foot 40 to move to loading station 30 and engage the garment piece a selected distance from the acceptable sewing line. The sewing machine 44 is then activated.

Robot presser foot 40 is moved to the sewing station 32 such that the garment piece is slidably moved through sewing machine 44. The garment piece is selectively moved through sewing machine 44 such that the garment piece is sewn along the acceptable sewing line. The sewing machine 44 is deactivated after the garment piece passes therethrough and the guidance program is ended.

Figure 9:
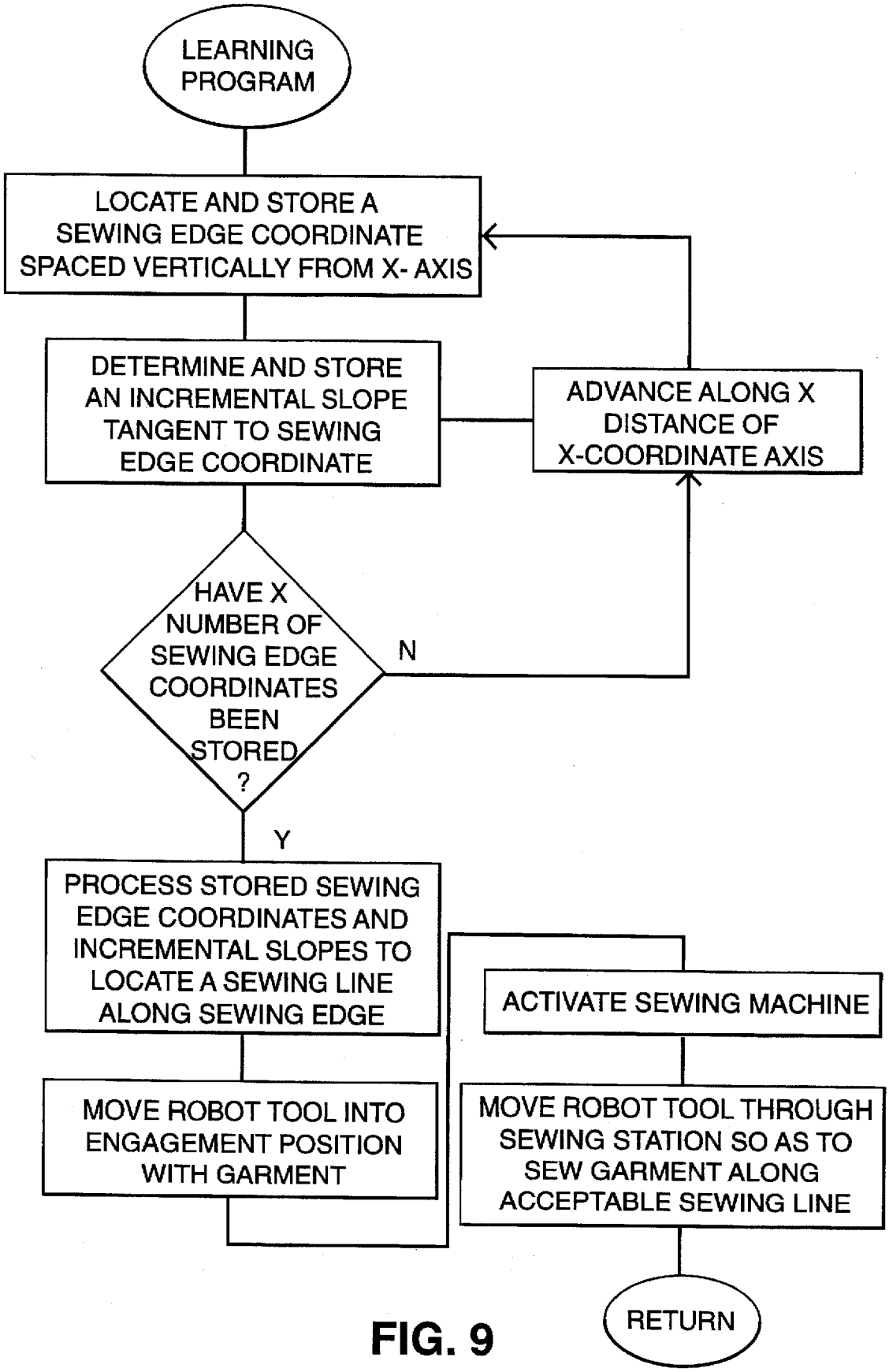
FIG. 9 is a flow chart of the learning program.

Referring to FIG. 9, the learning program is used where garment pieces having a sewing edge B with an unknown pattern are being loaded. To determine the pattern of sewing edge B, the learning program first locates and stores a sewing edge coordinate spaced vertically from the x-axis. The incremental slope tangent to the sewing edge coordinate is also calculated and stored. A selected number of sewing edge coordinates and their tangential slopes are determined and stored. The sewing edge coordinates and their tangential slopes are processed to form a sewing line adjacent to sewing edge B.

The learning program then moves the robot presser foot to the loading station 30 and engages the garment piece a selected distance from the sewing line. The sewing machine 44 is activated and the robot presser foot 40 moved in a planar path to the sewing station 32. The robot is controlled to move the garment piece through the sewing machine 44 such that the garment piece is sewn along the ideal sewing line. Sewing the garment piece along the ideal sewing line connects the bottom and upper layers of the garment piece together generally along the sewing edge B and the learning program is completed.

Figure 10:
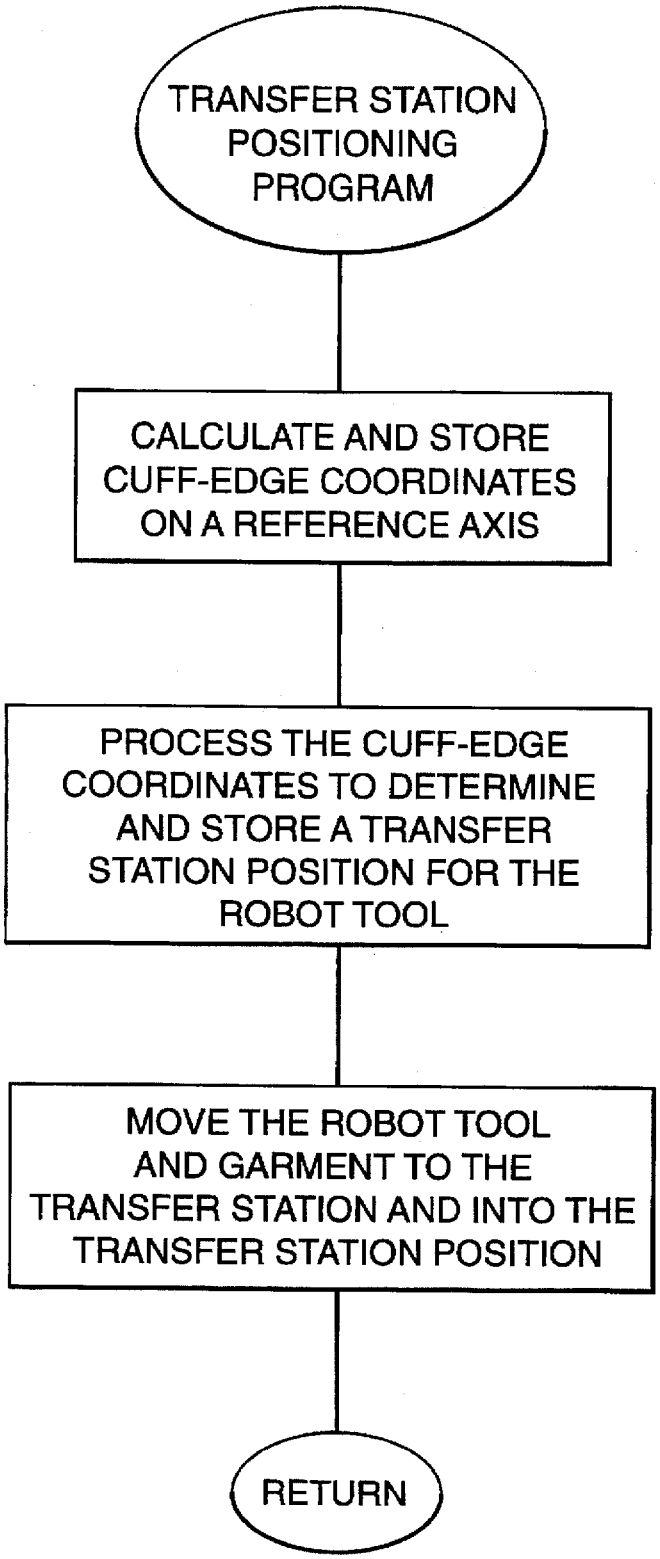
FIG. 10 is a flow chart of the transfer-station positioning program.

Referring to FIG. 10, the transfer station positioning program operates in conjunction with either the guidance program or the learning program. The transfer station positioning program operates to determine the position of the cuff edge C in the inspection station 30 so that the cuff edge C can be selectively positioned at transfer station 34.

While the garment piece is at the loading station 30, the transfer station positioning program calculates and stores cuff-edge coordinates on the reference axis. The cuff-edge coordinates are processed to determine how the robot presser foot 40 will be positioned at transfer station 34. The transfer station positioning program controls the movement of the robot presser foot 40 from the sewing station 32 to the transfer station 34 and how the garment piece is positioned at the transfer station.

The control program for the garment piece positioner and seamer 10 controls the sequence of operations required for the garment pieces to be sewn and transferred. The control program is designed such that operations on two different garment pieces are performed simultaneously. For example, a first garment piece can be transferred from sewing station 32 to transfer station 34 while, at the same time, a second garment piece is being inspected at loading station 30.

In order to provide such control of the operations performed the garment piece positioner and seamer 10, various status signals are generated and used. The generated status signals include a loaded signal generated when a garment piece is loaded at inspection station 30; a sewn signal generated when a garment piece is sewn at sewing station 32; and a transferred signal generated when a garment piece has been transferred from transfer station 34.

In operation, garment piece positioner and seamer 10 operates to automatically position and assemble garment pieces into a sleeve or pant leg. The sequence of positioning and assembling a garment piece into an assembled sleeve is shown in FIGS. 11A–11E. As shown in FIGS. 1–3 and FIG. 11A, a garment piece is initially loaded in the inspection area 56 of loading station 30 and camera 52 is activated. The garment piece G1 is inspected by vision system 20 and a loaded status signal is generated. If the garment piece G1 fails inspection, the robot presser foot 40 engages the garment piece and slidably moves the garment piece to a rejection area 35, shown in FIG. 11E, where the garment piece is discarded into a reject bin (not shown).

Figure 11A:
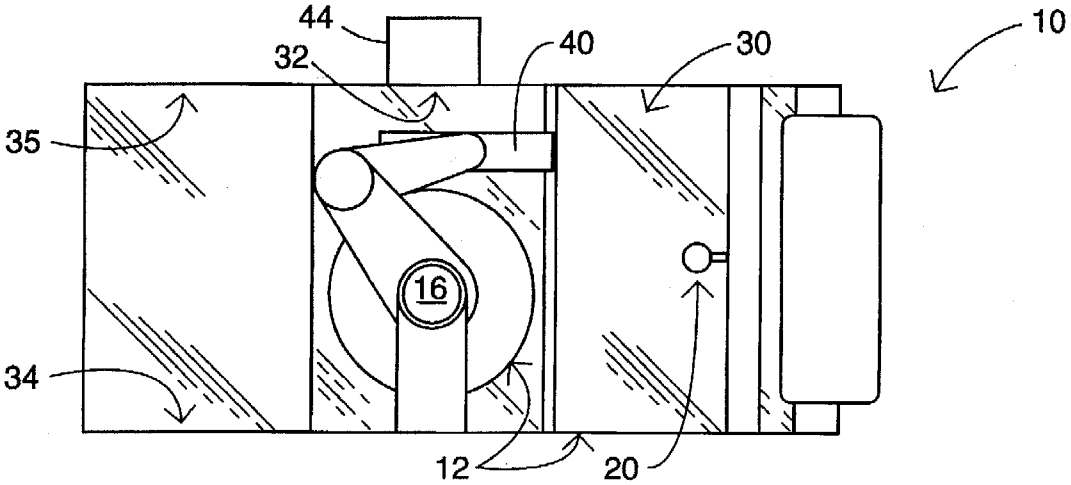
FIGS. 11A–11E are a sequence of schematic views showing a garment assembling cycle.
Figure 11B:
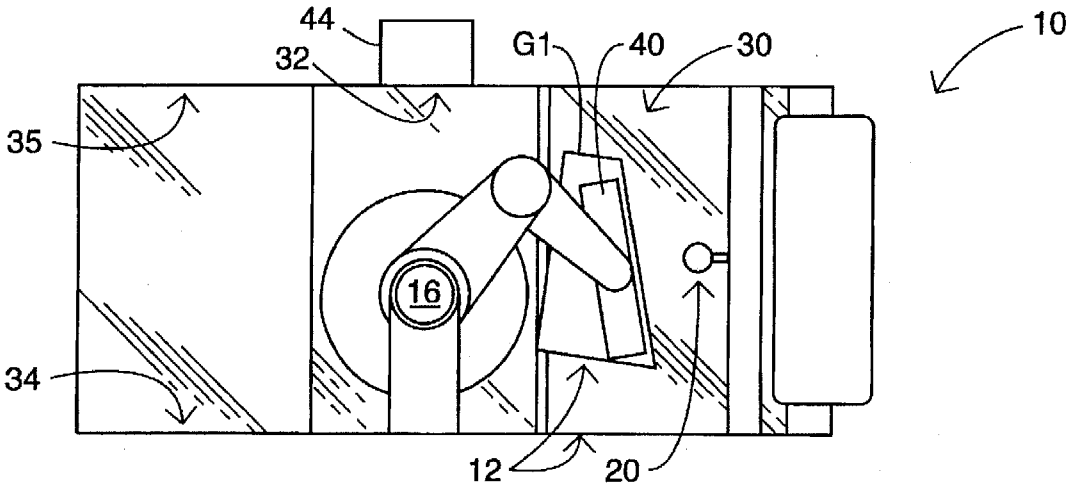
Figure 11C:
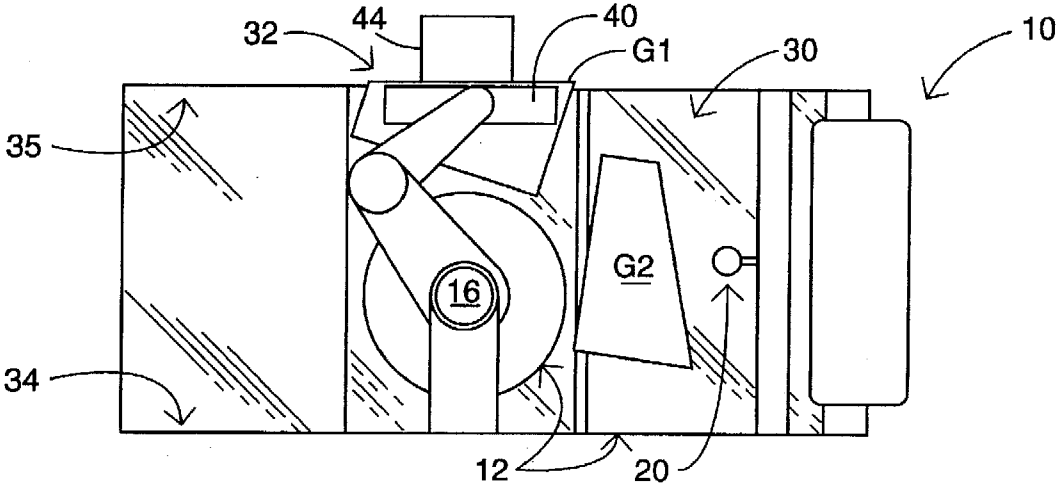
Figure 11E:
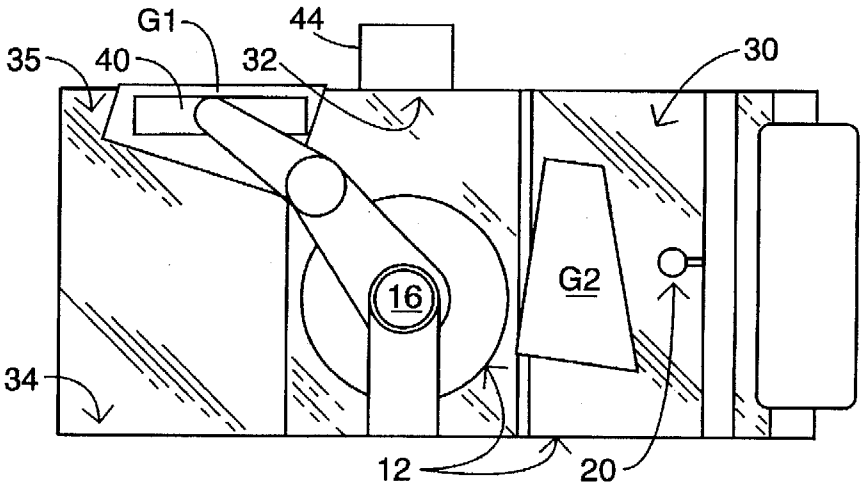

If the garment piece passes inspection, vision system 20 makes further calculations of the garment piece as previously discussed. Upon completion the inspection, camera 52 is turned off. The robot 16 then moves from a home position to the loading station 30 and engages the garment piece G1, as shown in FIG. 11B. The garment piece is then slidably moved from the loading station 30 to the sewing station 32, as shown in FIG. 11C, where the garment piece is sewn generally along the sewing edge of the garment piece. After the garment piece is sewn, a sewn signal is generated and camera 52 is turned on again.

As shown in FIG. 11C, another garment piece G2 is loaded at the loading station 30 as soon as robot 16 has moved garment piece G1 to the sewing station 32. Vision system 20 inspects the second loaded garment piece and generates a loaded signal for garment piece G2. As will be discussed below, the loaded signal for garment piece G2 controls the positioning of the robot 16 after garment piece G1 has been transferred from the transfer station 34.

Figure 11D:
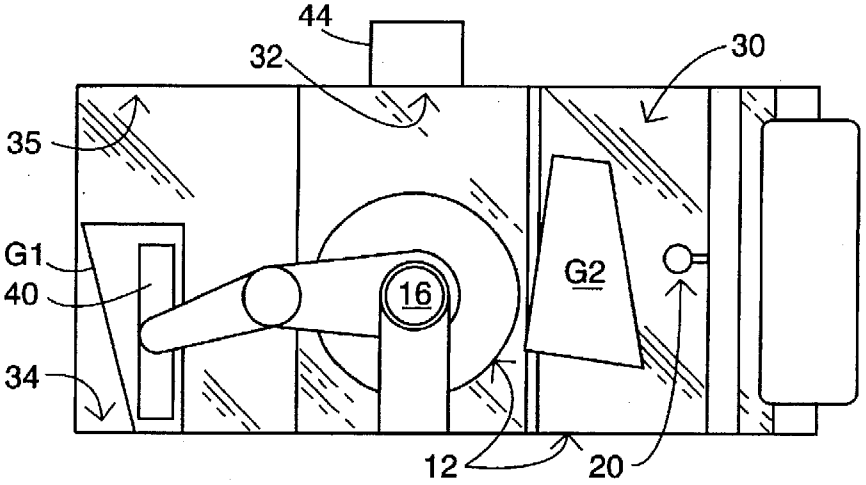

After sewing garment piece G1 at the sewing station 32, the robot presser foot 40 and garment piece G1 remain at the sewing station until a garment piece transfer signal is received. The garment piece transfer signal indicates that there is not another garment piece at transfer station 34. Once the garment piece transfer signal is received, the robot presser foot 40 moves garment piece G1 to the transfer station 34, as shown in FIG. 11D, where the cuff edge is properly positioned for a cuff to be attached to garment piece G1.

After the garment piece G1 has been transferred from transfer station 34, robot 16 determines if a loaded signal has been generated for garment G2. If a loaded signal has been generated, the robot 16 moves directly from the transfer station 34 to the loading station 30 and engages the loaded garment piece. The positioning and assembling of the engaged garment piece is then performed as previously discussed. If the a garment piece loaded signal is not detected, the robot 16 moves to the home position and awaits for the loading of another garment piece. Directly positioning the robot from the transfer station 34 to the loading station 30 when a garment piece loaded signal is generated improves the efficiency of the positioning and assembling process.

Garment piece positioner and seamer 10 provides an efficient device and method for positioning and assembling garment pieces. Garment piece positioner and seamer provides for precise positioning at various work stations of randomly loaded garment pieces.

Certain modifications and improvements will occur to those skilled in the art upon a reading of the foregoing description. By way of example, the present invention can be adapted to assemble other "flat" sewn garments such as shirt shoulder seams and side and crotch seams for briefs. Also, binding or edge trim could be applied. It should be understood that all such modifications and improvements have been deleted herein for the sake of conciseness and readability but are properly within the scope of the following claims.

We claim:

1. An apparatus for receiving a garment piece at a first workstation and moving said garment piece to a second workstation, said apparatus comprising:

(a) a garment piece transfer system located adjacent to said first workstation for engaging said garment piece at said first workstation and for moving said garment piece to said second workstation;

(b) a vision and control system located adjacent to said first workstation for determining the position of said garment piece at said first workstation and sending a control signal to said garment piece transfer system to engage said garment piece at said first workstation and move said garment piece to said second workstation; and (c) wherein said vision and control system determines a parameter value for a selected parameter for said garment piece in said first workstation and compares said determined parameter value with a reference parameter value stored in said vision and control system, and wherein said garment is selectively placed in a reject class or a non-reject class based on said comparison of said determined and reference parameter values, and wherein said garment piece transfer system moves said garment piece to said second workstation in response to said garment piece being placed in said non-reject class.

2. The apparatus according to claim 1, wherein said first workstation is a loading station.

3. The apparatus according to claim 1, wherein said second workstation includes a sewing machine for performing a sewing operation on said garment piece.

4. The apparatus according to claim 1, further including a third workstation downstream of said second workstation.

5. The apparatus according to claim 4, wherein said third workstation is an unloading station.

6. The apparatus according to claim 1, wherein said vision and control system produces garment piece location data for said garment piece at the first station and wherein said garment piece transfer system engages said garment piece at said first workstation and moves said garment piece to said second workstation to a predetermined position at said second workstation.

7. The apparatus according to claim 6, wherein said vision and control system positions a reference axis with respect to said garment piece at said first workstation and wherein said garment piece location data is produced with respect to the reference axis.

8. The apparatus according to claim 7, wherein said garment piece at said first workstation has a first edge and an opposed second edge and wherein said vision and control system produces a reference x-axis located substantially along said first edge of said garment piece and a reference y-axis located substantially along said second edge of said garment piece.

9. The apparatus according to claim 8, wherein said vision and control system forms a first search region for locating said first edge of said garment piece in said first search region.

10. The apparatus according to claim 9, wherein said vision and control system forms a second search region for locating said second edge of said garment piece in said second search region.

11. An apparatus for receiving a garment piece at a first workstation and moving said garment piece to a second workstation in combination with a sewing device, said apparatus comprising:

(a) a garment, piece transfer system located adjacent to said first workstation for engaging said garment piece at said first workstation and for moving said garment piece to said second workstation, said transfer system including: (i) a support table located between said first workstation and said second workstation having a smooth, generally horizontal planar top surface for supporting said garment piece thereon; and (ii) a robot positioned adjacent said table and having an arm and presser foot attached thereto, said robot arm including means for selectively moving said presser foot between a non-engagement position and an engagement position with said planar surface whereby said presser foot engages said garment piece on the surface of said support table, said robot arm including means for moving said presser foot between said first workstation and said second workstation when in said engagement position to slidably move said garment piece along the surface of said table from said first workstation to said second workstation; and (b) a vision and control system located adjacent to said first workstation for determining the position of said garment piece at said first workstation and sending a control signal to said garment piece transfer system to engage said garment piece at said first workstation and move said garment piece to said second workstation;

said sewing device comprising:

(c) a sewing machine located at said second workstation for performing a sewing operation on said garment piece; and p1 (d) wherein said vision and control system determines a parameter value for a selected parameter for said garment piece in said first workstation and compares said determined parameter value with a reference parameter value stored in said vision and control system, and wherein said garment is selectively placed in a reject class or a non-reject class based on said comparison of said determined and reference parameter values, and wherein said presser foot moves said garment piece to said second workstation for sewing in response to said garment piece being placed in said non-reject class.

12. The apparatus according to claim 11, wherein said first workstation is a loading station.

13. The apparatus according to claim 11, further including a third workstation downstream of said second workstation.

14. The apparatus according to claim 13, wherein said third workstation is an unloading station.

15. The apparatus according to claim 11, wherein said vision and control system produces garment piece location data for said garment piece at the first station and wherein said garment piece transfer system engages said garment piece at said first workstation and moves said garment piece to said second workstation to a predetermined position at said second workstation.

16. The apparatus according to claim 15, wherein said vision and control system positions a reference axis with respect to said garment piece at said first workstation and wherein said garment piece location data is produced with respect to the reference axis.

17. The apparatus according to claim 16, wherein said garment piece at said first workstation has a first edge and an opposed second edge and wherein said vision and control system produces a reference x-axis located substantially along said first edge of said garment piece and a reference y-axis located substantially along said second edge of said garment piece.

18. The apparatus according to claim 17, wherein said vision and control system forms a first search region for locating said first edge of said garment piece in said first search region.

19. The apparatus according to claim 18, wherein said vision and control system forms a second search region for locating said second edge of said garment piece in said second search region.

20. The apparatus according to claim 11, wherein the top surface of said table is a sheet of glass.

21. The apparatus according to claim 11, wherein the top surface of said table is a sheet of transparent plastic.

22. The apparatus according to claim 11, wherein said presser foot includes a generally horizontal planar bottom surface for engaging said garment piece on the top surface of said table.

23. The apparatus according to claim 22, wherein said presser foot is sized to substantially the same dimensions as said garment piece.

24. The apparatus according to claim 11, wherein said means for selectively moving said presser foot between a non-engagement position and an engagement position with said planar top surface is a vertical actuator.

25. The apparatus according to claim 11, wherein said means for moving said presser foot between said first workstation and said second workstation is a rotary actuator.

26. The apparatus according to claim 11 wherein said vision and control system produces garment piece location data corresponding to the location of said garment piece in said first workstation, wherein, based on said garment piece location data, said vision and control system locates an imaginary sewing line on said garment piece, wherein said presser foot slideably moves said garment piece along a selected path from the first work station to the second workstation and through said sewing machine so as to sew said garment piece along said imaginary sewing line.

27. The apparatus according to claim 26, wherein said vision and control system positions a reference axis with respect to said garment piece at said first workstation and wherein said garment piece location data is produced with respect to the reference axis.

28. The apparatus according to claim 11, wherein said presser foot moves said garment at the first workstation to a rejection area where said garment piece is discarded in response to said garment being placed in said rejection class.

29. The apparatus according to claim 11, wherein, based on said determined parameter values and said reference parameter values, said garment piece falling within said non-reject class is further placed in an ideal garment piece class and an acceptable garment piece class, wherein said garment piece falling within said ideal garment piece class is positioned on said garment in a first manner and said garment piece falling within said acceptable garment piece class is positioned in a second manner.

30. The apparatus according to claim 11, wherein said first manner for positioning said garment piece falling within said ideal class includes positioning said imaginary sewing line a selected distance from a first edge of said garment piece, wherein said second manner for positioning said garment piece falling within said acceptable class includes positioning said imaginary sewing line a selected distance from a second edge of said garment piece disposed opposite said first edge.

31. The apparatus of claim 11 wherein said determined parameter value is a distance between a first and a second edge of said garment piece.

32. The apparatus of claim 26 wherein said garment piece location data includes a stored predetermined imaginary sewing line corresponding to a predetermined pattern for a reference garment piece, wherein said vision and control system locates said predetermined imaginary sewing line at a selected location on said garment piece.

33. The apparatus according to claim 11, wherein said garment piece includes a sewing edge having a pattern unknown to the vision and control system, wherein said vision and control system after said garment piece has been located at said first workstation measures said garment piece so as to generate sewing edge data corresponding to said sewing edge, and wherein said vision and control system forms an imaginary sewing line adjacent said sewing edge based on said sewing edge data.

34. The apparatus of claim 11, wherein a protection area is located adjacent said first workstation, and wherein the presser foot waits for the protection area to become unobstructed prior to moving to said engagement position.

35. The apparatus according to claim 11, wherein said vision and control system generates a loaded status signal at a time when said garment piece is loaded at said first workstation, and wherein said presser foot when located at another workstation is moved directly to said first workstation in response to said loaded status signal and is moved to a home position in the absence of said loaded signal.

36. The apparatus according to claim 33, wherein said vision and control system identifies the location and tangential slope on a reference axis of a plurality of sewing edge points along said sewing edge and determines the pattern for said imaginary sewing line for said unknown sewing edge pattern.

37. The apparatus according to claim 26, wherein, prior to being positioned in the engagement position and based on said garment location data, said presser foot is rotated to a selected orientation with respect to said garment piece.

38. A method for receiving a garment piece at a first workstation and moving said garment piece to a second workstation, said method comprising the steps of:

(a) engaging said garment piece at said first workstation and moving said garment piece to said second workstation by a garment piece transfer system located adjacent to said first workstation;

(b) determining a parameter value for a selected parameter for said garment piece in said first workstation;

(c) comparing said determined parameter value with a reference parameter value wherein said garment is selectively placed in a reject class or a non-reject class based on said comparison of said determined and reference parameter values; and (d) determining the position of said garment piece at said first workstation and sending a control signal to said garment piece transfer system to engage said garment piece at said first workstation and move said garment piece to said second workstation by a vision and control system located adjacent to said first workstation when said garment is placed in said non-reject class.

39. A method for receiving a garment piece at a first workstation, moving said garment piece to a second workstation, and performing a sewing operation on said garment piece said method comprising the steps of:

(a) engaging said garment piece at said first workstation and moving said garment piece to said second workstation by a garment piece transfer system located adjacent to said first workstation, said transfer system including: (i) a support table located between said first workstation and said second workstation having a smooth, generally horizontal planar top surface for supporting said garment piece thereon; and (ii) a robot positioned adjacent said table and having an arm and presser foot attached thereto, said robot arm including means for selectively moving said presser foot between a non-engagement position and an engagement position with said planar surface whereby said presser foot engages said garment piece on the surface of said support table, said robot arm including means for moving said presser foot between said first workstation and said second workstation when in said engagement position to slidably move said garment piece along the surface of said table from said first workstation to said second workstation;

(b) determining a parameter value for a selected parameter for said garment piece in said first workstation;

(c) comparing said determined parameter value with a reference parameter value wherein said garment is selectively placed in a reject class or a non-reject class based on said comparison of said determined and reference parameter values;

(d) determining the position of said garment piece at said first workstation and sending a control signal to said garment piece transfer system to engage said garment piece at said first workstation and move said garment piece to said second workstation by a vision and control system located adjacent to said first workstation when said garment is placed in said non-reject class; and (e) performing a sewing operation on said garment piece by a sewing machine located at said second workstation.

* * * * *